US005133116A

United States Patent [19]

Wagner et al.

[11] Patent Number: 5,133,116

[45] Date of Patent: Jul. 28, 1992

[54] METHOD OF STABILIZING AND REINFORCING A SPRING BORDER

[75] Inventors: Robert F. Wagner, Medina; William W. Freeman, Lodi, both of Ohio

[73] Assignee: The Ohio Mattress Company Licensing and Components Group, Cleveland, Ohio

[21] Appl. No.: 633,408

[22] Filed: Dec. 21, 1990

[51] Int. Cl.[5] ..... B68G 7/00

[52] U.S. Cl. ..... 29/91; 5/474

[58] Field of Search ..... 29/91, 91.1; 5/474

[56] References Cited

U.S. PATENT DOCUMENTS

| | | | |
|---|---|---|---|
| 2,408,382 | 10/1946 | Dubick | 5/360 |
| 2,826,769 | 3/1958 | Drews | 5/474 |
| 2,940,089 | 6/1960 | Koenigsberg | 5/474 |
| 3,262,135 | 7/1966 | Fasanella | 5/351 |
| 3,618,146 | 11/1971 | Ferdinand | 5/474 |
| 3,822,426 | 7/1974 | Mistarz | 5/474 |
| 3,848,283 | 11/1974 | Ikeda | 5/474 |
| 4,067,076 | 1/1978 | Krier | 5/474 |

*Primary Examiner*—P. W. Echols

*Attorney, Agent, or Firm*—Willian Brinks Olds Hofer Gilson & Lione

[57] ABSTRACT

The border of a mattress or other such coil spring assembly is stabilized and reinforced using a continuous length of resilient rope which is wedged between convolutions of adjacent springs a plurality of turns about the perimeter of the coil spring assembly.

5 Claims, 2 Drawing Sheets

METHOD OF STABILIZING AND REINFORCING A SPRING BORDER

FIELD OF THE INVENTION

This invention relates generally to a method of providing a border stabilizer, and more specifically to a method of stabilizing the edges of mattresses, box springs, seat cushions, and other upholstered items using spring assemblies as a support surface.

BACKGROUND OF THE INVENTION

The edges of mattresses, box springs, seat cushions and other upholstered items are typically subjected to added stresses and strains as compared to the body of the mattress or like device. The edges bear the added force associated with sitting on and standing up from the edge. These forces are also more concentrated at the edge during rising and sitting, since the remainder of the spring assembly typically is not involved, and therefore does little to distribute the forces.

The edge areas are therefore subjected to greater compression forces than the body of the item. The greater compression forces and added stress and strains to which the edges of a mattress, in particular, are subjected to often cause these areas to wear much more quickly than the main body of such items. This type of wear results in tipping or side sway effects about the border of the mattress. Wear of this type reduces the full comfort of the item, and results in unevenness.

It is thus desirable to reinforce and provide greater stability to the edges of a mattress or similar spring cushion assembly. Products with reinforced borders have been developed to reduce early wear about the edge of a mattress or like device, and otherwise stabilize the border.

For instance, U.S. Pat. No. 3,848,283 discloses a mattress in which a rectangular frame elastic foam is fit into void spaces left in the sides of the spring coil assembly. The foam frame is held in place by its own contraction and an outermost covering which envelopes the whole mattress body.

Another device, shown in U.S. Pat. No. 3,822,426, has a combined mattress topper pad and border stabilizer which is formed as a single unitary member having a mattress topper pad portion and a border stabilizer portion. One or more slits are provided in the stabilizer portion to fit the generally rectangular cross-sectioned frame onto the springs.

U.S. Pat. No. 3,618,146 discloses a border stabilizer formed from a plurality of foam strips which are positioned along the peripheral row of spring coils. Each strip is slit to fit over one or more convolutions of the outermost coils.

None of the previously disclosed mattresses and border stabilizers, however, provide for a border stabilizer that does not extend beyond the spring border of the spring coil unit. These prior art devices also use a plurality of frame strips that must be sized to the particular unit, or a single unitary foam frame that likewise must be generally sized to the unit for a proper fit. The necessity to stock the various size foam strips is undesirable, as is the alternative of cutting a foam strip to size. Moreover, handling and forming multiple strips increases the time and labor in assembly.

SUMMARY OF THE INVENTION

The present invention is a method of stabilizing the border of a cushioned article, such as the perimeter of mattresses, box springs, seat cushions and other upholstered items that use a spring foundation, by wrapping a continuous strip or rope of foam within the convolutions of the outermost perimeter coils a plurality of times. The border of the mattress or like device is thereby stabilized, and the rope of foam is easily affixed within the convolutions of the outermost adjacent spring coils. Since a continuous length of foam is used, no sizing, cutting or other modification of the foam is required from one size unit to the next. Nor are any special slits or other means required to affix the foam rope, as used in the present invention.

In a preferred embodiment of the present invention, a single continuous length of resilient foam having a circular cross-section is threaded within the convolutions of the outermost spring coils three times around the unit. The foam strip is supplied on a spool-like device, and is easily unwound as a worker progresses about the unit. The number of times the strip is wound may vary with the number of spring convolutions, and the desired reinforcement.

In addition to the time, labor and inventory savings noted above, the present invention improves the compression resistance about the perimeter of the spring unit, reducing sagging along the edges of the mattress or like device. Additionally, the method of the present invention does not interfere with the edge appearance of the unit since the foam rope is maintained entirely within the spring convolutions.

The present invention, together with its attendant advantages, will be further understood by reference to the following detailed description of a preferred embodiment, taken in conjunction with the accompanying drawings, in which:

DETAILED DESCRIPTION OF THE PREFERRED EMBODIMENT

Figure 1:
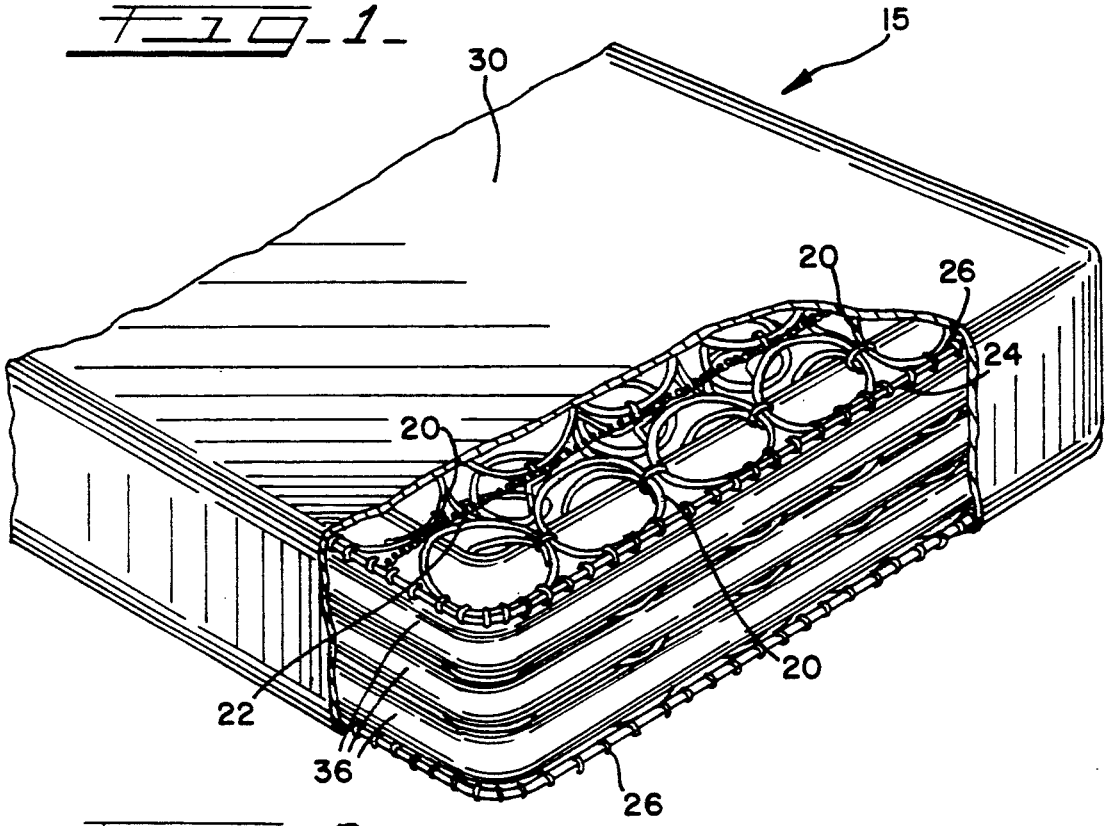
FIG. 1 is a perspective view of a mattress made in accordance with the present invention.

Referring now to the drawings, mattress 15 has had its border stabilized in accordance with the present method. The mattress 15 includes a plurality of spring coils 20, each comprised of a series of convolutions. The spring coils 20 are attached to one another by cross-helical wires 22.

The perimeter of the spring coils is defined by a spring border rod 24 to which the terminal convolution of each of the outermost spring coils 20 is secured by border helical wires 26. Ticking, padding and covering material (generally indicated at 30) finish out the unit.

In accordance with the present invention, a strip or rope of resilient foam 36 is wrapped about the perimeter spring coils. The foam rope has a generally circular cross-sectional area and is in one piece. The rope of resilient foam 36 is wound about the outermost perimeter of the spring coils, being threaded between the convolutions of these outermost spring coils.

The adjacent spring coils shown have three convolutions or turns per coil, although more convolutions do not affect the practice of the invention. The convolutions of the spring coils tend to form a series of parallel planes. In the illustrated embodiment, three such planes of convolutions are formed. The rope of foam is threaded in a continuous length within each of these three planes of convolutions seriatim, as illustrated at 40, 42, and 44 respectively.

The rope of resilient foam is wedged into the convolutions of the spring coils. Accordingly, when a plurality of the convolutions are reinforced with the resilient foam in successive planes 40, 42, and 44, resistance to compression is increased about the outer perimeter of the mattress. A firmer edge is thereby obtained.

Figure 2:
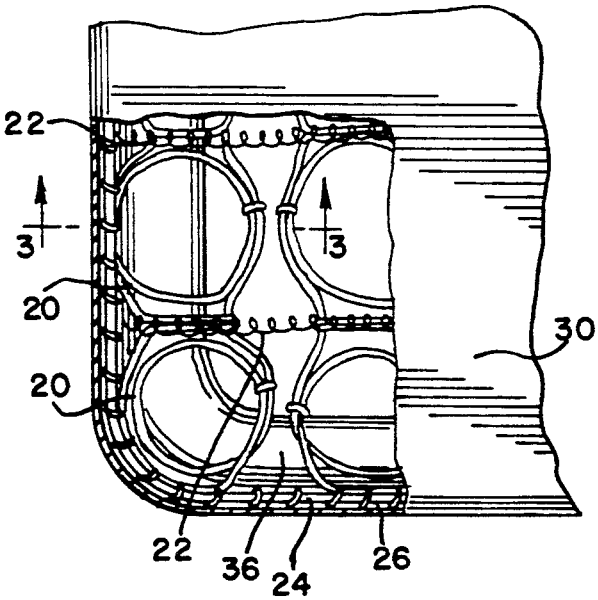
FIG. 2 is an enlarged view of a corner portion of the mattress of FIG. 1 with a portion cut away for clarity.
Figure 3:
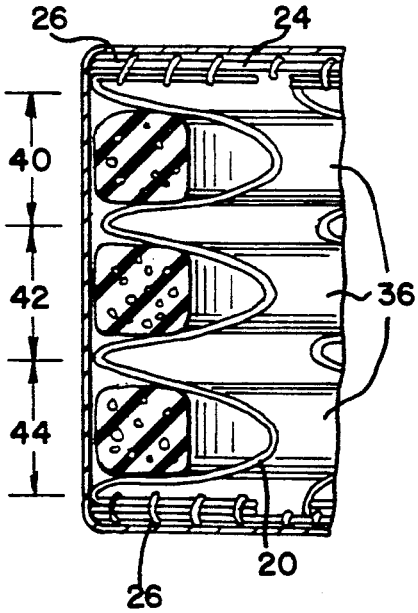
FIG. 3 is an enlarged cross-sectional view taken along line 3—3 of FIG. 2.

Additionally, as illustrated in FIG. 2, the rope of resilient foam is also threaded far enough within the convolutions of the spring coils such that the foam does not extend beyond the spring border rod 24. The foam accordingly does not affect the look of the mattress sides.

Figure 4:
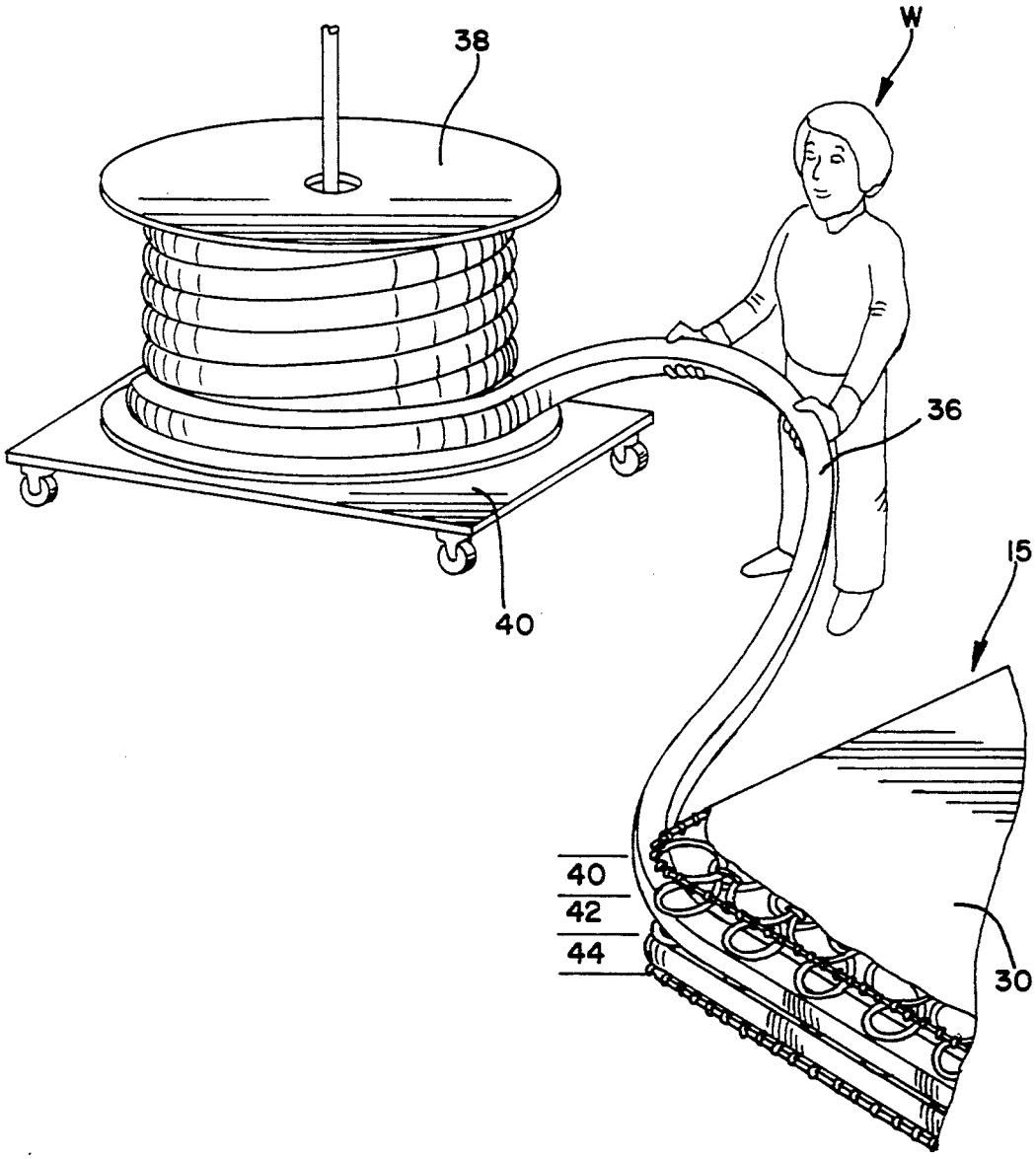
FIG. 4 illustrates the presently preferred practice of the inventive method.

FIG. 4 illustrates how the foam rope is preferably applied. Worker W begins by inserting the end of the foam rope 36 into a first plane of spring convolutions. Worker W then moves around the mattress 15, feeding the rope 36 into and between the successive convolutions in a plane. Rope 36 is supplied on a large spool or drum 38 from which it is unwound. The spool 38 may be stationarily mounted, or more advantageously, mounted for movement with the worker on a rolling dolly 40.

After completing the fitting of the rope 36 into a first plane, the worker W continues to the next plane and so on until the requisite number of desired layers are built up. The rope 36 is then cut, with the cut end tucked into a final spring convolution.

The resilient foam employed for the present invention may be any durable elastically compressible foam, such as polyurethane foam, polyethylene foam, foam rubber, or latex foam. Preferably, the foam used will have a tensile strength which resists tearing. By varying the density and rigidity of the foam, the degree to which the foam resists compression can be adjusted as desired.

The foregoing description of the preferred embodiment of the present invention has been presented for purposes of illustration and description. It is not intended to be exhaustive or to limit the invention to the precise form disclosed. Modifications and variations are possible in light of the above teachings, yet still fall within the scope of the claims hereafter. It is intended that the scope of the invention be defined by the following claims, including all equivalents.

What is claimed is:

1. A method of stabilizing and reinforcing the perimeter of a spring coil assembly comprising the steps of:

providing a rope of resilient material, and winding a continuous length of said rope about the perimeter of the assembly a plurality of turns by wedging said rope between convolutions of the spring coils to form successive resilient layers of said rope around the perimeter.

2. A method of stabilizing and reinforcing the perimeter of a spring coil mattress comprising the steps of:

providing a mattress innerspring having a plurality of adjacent spring coils, each coil having a plurality of convolutions;

providing a continuous length of resilient material; and winding a continuous length of said resilient material about the perimeter of said innerspring a plurality of turns by wedging said resilient material between adjacent convolutions of said spring coils in successive planes defined by said convolutions.

3. A method of stabilizing and reinforcing the perimeter of a spring coil mattress comprising the steps of:

providing a mattress innerspring having a plurality of adjacent spring coils, each coil having a plurality of convolutions which define successive parallel planes in the innerspring;

providing a continuous length of resilient material; and threading said resilient material between said convolutions of adjacent spring coils about the outermost perimeter of said innerspring a plurality of times and in successive planes to form successive resilient layers of said resilient material around the perimeter.

4. A method of stabilizing and reinforcing the perimeter of a spring mattress comprising the steps of:

providing a mattress innerspring having a plurality of adjacent spring coils, each coil having a plurality of convolutions which define a plurality of parallel convolution planes;

providing a continuous length of resilient foam rope on a rotatable spool;

threading and wedging said rope in a continuous piece between successive adjacent convolutions by a plurality of turns about the innerspring and in a plurality of said planes to form successive resilient foam rope layers around the perimeter.

5. The method of claim 4 wherein said rotatable spool is mounted for movement about said innerspring.

* * * * *